US010900297B2

(12) United States Patent
Ong et al.

(10) Patent No.: US 10,900,297 B2
(45) Date of Patent: Jan. 26, 2021

(54) SYSTEMS AND METHODS OF A MODULAR STABILIZER TOOL

(71) Applicant: Halliburton Energy Services, Inc., Houston, TX (US)

(72) Inventors: Shijie Ong, Singapore (SG); Alston Wong, Singapore (SG); Yamone Wai Zun, Singapore (SG); Gabriel Yun Chong Chang, Singapore (SG); Han Yeou Ng, Singapore (SG)

(73) Assignee: Halliburton Energy Services, inc., Houston, TX (US)

( * ) Notice: Subject to any disclaimer, the term of this patent is extended or adjusted under 35 U.S.C. 154(b) by 81 days.

(21) Appl. No.: 16/323,028

(22) PCT Filed: Sep. 14, 2016

(86) PCT No.: PCT/US2016/051663
§ 371 (c)(1),
(2) Date: Feb. 4, 2019

(87) PCT Pub. No.: WO2018/052411
PCT Pub. Date: Mar. 22, 2018

(65) Prior Publication Data

US 2020/0087995 A1 Mar. 19, 2020

(51) Int. Cl.
*E21B 17/10* (2006.01)
*E21B 47/00* (2012.01)
*E21B 47/16* (2006.01)

(52) U.S. Cl.
CPC ..... *E21B 17/1078* (2013.01); *E21B 47/00* (2013.01); *E21B 47/16* (2013.01)

(58) Field of Classification Search
CPC ..... E21B 17/1078
See application file for complete search history.

(56) References Cited

U.S. PATENT DOCUMENTS 2,023,266 A * 12/1935 Davis ..... E21B 17/1085 175/325.2
2,973,996 A * 3/1961 Self ..... E21B 17/1078 175/325.7

(Continued)

FOREIGN PATENT DOCUMENTS

CA 2342594 A1 10/2001
EP 0615572 A4 5/1997

(Continued)

OTHER PUBLICATIONS

Bailey, Jeffrey R., et al. "Design Evolution of Drilling Tools to Mitigate Vibrations." SPE Drilling & Completion 28.04 (2013): 350-369.

(Continued)

*Primary Examiner* — Robert E Fuller
(74) *Attorney, Agent, or Firm* — Benjamin Ford; Baker Botts L.L.P.

(57) ABSTRACT

Modular stabilizer tools may be used to reduce unwanted deflection of a wellbore and in effecting a desired change in direction of a wellbore in an efficient and inexpensive manner. As the diameter of a wellbore changes, the modular stabilizers plates may be configured to expand or decrease the outer diameter of a modular stabilizer tool without requiring removal of an entire section of the drill string. Each modular stabilizer plate of a modular stabilizer tool may be configured to align and affix to any one or more other modular stabilizer plates and may be of any size or shape. A site need only maintain a small inventory of modular stabilizer plates instead of entire collars, tools, or sections of a drill string. When any modular stabilizer plate, especially an outer spacer stabilizer plate, experiences wear or damage, it may be replaced without the requirement of replacing an entire collar.

20 Claims, 4 Drawing Sheets

(56) References Cited

U.S. PATENT DOCUMENTS

| | | | | |
|---|---|---|---|---|
| 3,454,308 | A * | 7/1969 | Kennedy | E21B 17/1078 175/325.4 |
| 4,101,179 | A | 7/1978 | Barron | |
| 4,156,374 | A * | 5/1979 | Shwayder | B23P 6/00 175/325.2 |
| 4,190,124 | A * | 2/1980 | Terry | E21B 10/26 175/325.4 |
| 4,280,742 | A * | 7/1981 | Justman | E21B 17/1078 175/325.4 |
| 4,378,135 | A | 3/1983 | Enen, Jr. et al. | |
| 4,378,852 | A * | 4/1983 | Garrett | E21B 10/62 175/325.4 |
| 4,456,080 | A | 6/1984 | Holbert | |
| 4,662,461 | A * | 5/1987 | Garrett | E21B 17/1078 175/325.4 |
| 5,250,806 | A | 10/1993 | Rhein-Knudsen et al. | |
| 5,354,956 | A | 10/1994 | Orban et al. | |
| 5,447,207 | A * | 9/1995 | Jones | E21B 17/1078 175/325.4 |
| 5,868,212 | A * | 2/1999 | McManus | E21B 10/26 175/325.4 |
| 6,202,752 | B1 | 3/2001 | Kuck et al. | |
| 6,260,636 | B1 * | 7/2001 | Cooley | E21B 10/00 175/408 |
| 6,328,119 | B1 | 12/2001 | Gillis et al. | |
| 7,188,689 | B2 | 3/2007 | Maxwell et al. | |
| 8,448,722 | B2 | 5/2013 | Konschuh et al. | |
| 2004/0011559 | A1 | 1/2004 | Harvey et al. | |
| 2004/0178797 | A1 * | 9/2004 | Rioufol | E21B 47/017 324/367 |
| 2013/0133882 | A1 | 5/2013 | Harms et al. | |
| 2014/0305703 | A1 | 10/2014 | Izbinski | |
| 2015/0053393 | A1 | 2/2015 | Ortiz et al. | |
| 2016/0032708 | A1 * | 2/2016 | Mahjoub | E21B 47/017 166/66 |
| 2016/0209543 | A1 * | 7/2016 | Valero | E21B 47/02 |
| 2016/0230465 | A1 | 8/2016 | Holtz et al. | |
| 2016/0237762 | A1 | 8/2016 | Khaparde et al. | |
| 2017/0328144 | A1 * | 11/2017 | Roberson | E21B 17/1078 |
| 2018/0229467 | A1 * | 8/2018 | Walker | B32B 7/08 |

FOREIGN PATENT DOCUMENTS

| | | | |
|---|---|---|---|
| WO | 2003/002840 | A2 | 1/2003 |
| WO | 2012/039707 | A1 | 3/2012 |
| WO | 2013/074593 | A1 | 5/2013 |

OTHER PUBLICATIONS

International Search Report and Written Opinion issued in related PCT Application No. PCT/2016/051663 dated Jun. 7, 2017, 16 pages.

Eddison, A., and J. Symons. "Downhole Adjustable Gauge Stabilizer Improves Drilling Efficiency in Directional Wells." 'SPE Annual Technical Conference and Exhibition (SPE 20454). Society of Petroleum Engineers, 1990.

* cited by examiner

SYSTEMS AND METHODS OF A MODULAR STABILIZER TOOL

CROSS-REFERENCE TO RELATED APPLICATION

The present application is a U.S. National Stage Application of International Application No. PCT/US2016/051663 filed Sep. 14, 2016, which is incorporated herein by reference in its entirety for all purposes.

BACKGROUND

The present application is directed to a downhole drilling assembly and more specifically, to a modularized stabilizer for improving performance and reducing cost of a drilling operation.

Hydrocarbons, such as oil and gas, are commonly obtained from subterranean formations. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Directional drilling involves controlling the direction of a wellbore as it is being drilled. As wellbores are drilled in three dimensional space, the direction of a wellbore includes both its inclination relative to vertical as well as its azimuth. Generally, a drilling operation is performed to reach a target subterranean destination with the drill string or drilling assembly. It may be necessary during the directional drilling operation to adjust or alter the direction of the wellbore. For example, it may be determined to advance to a new target, change direction due to or according to a predetermined plan, or compensate for unintended and unwanted deflection of the wellbore. Unwanted deflection may result from a variety of factors, including the characteristics of the formation being drilled, the makeup of the bottom hole drilling assembly and the manner in which the wellbore is being drilled.

Directional drilling may utilize any number of drilling techniques. The design of the bottom hole assembly or drilling assembly may improve the effectiveness and accuracy of the drilling operation. Stabilizers may be used in the bottom hole assembly to reduce unwanted deflection of a wellbore and in effecting a desired change in direction of the wellbore. The stabilizers stabilize the drilling bit that is attached to the distal end of the bottom hole assembly so that it rotates properly on its axis. When a bottom hole assembly is properly stabilized, the weight applied to the drilling bit can be optimized. The stabilizers also assist in steering the drill string so that the direction of the wellbore can be controlled. For example, properly positioned stabilizers can assist, for example, in increasing or decreasing the deflection angle of the wellbore either by supporting the drill string near the drilling bit or by not support the drill string near the drilling bit.

Conventional stabilizers generally are either fabricated as a single piece with a drill collar or welded to the outer surface of the bottom hole assembly. As the wellbore size varies, the drill string may be required to be removed and a different sized collar incorporating a smaller or larger stabilizer may need to be fitted on the drill string. Also, stabilizers may suffer from wear and tear due to the extreme forces applied to the stabilizers downhole which may require replacement of an entire section of the drill string or bottom hole assembly. Such a stabilizer replacement procedure has costs not only in the delay of the drilling operation but also with the required maintenance of inventory for these different sized stabilizer components.

BRIEF DESCRIPTION OF THE DRAWINGS

The present disclosure will be more fully understood by reference to the following detailed description of the preferred embodiments of the present disclosure when read in conjunction with the accompanying drawings, in which like reference numbers refer to like parts throughout the views, wherein.

Figure 1:
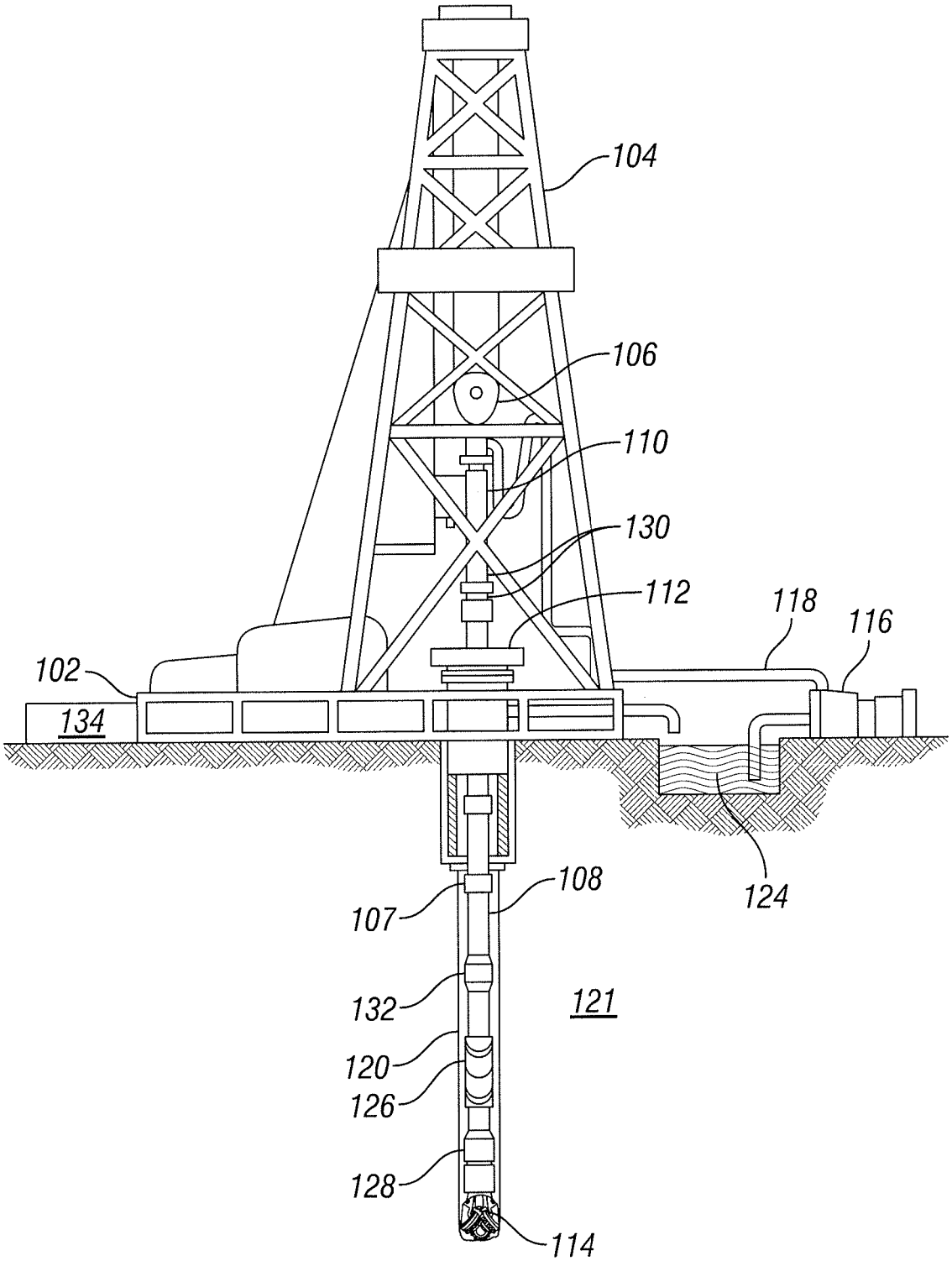
FIG. 1 shows an illustrative logging while drilling environment according to one or more embodiments of the present disclosure.

The disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes which come within the meaning and range of equivalency of the claims are therefore intended to be embraced therein.

DETAILED DESCRIPTION OF THE DISCLOSURE

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation including subsea formations. Embodiments may be applicable to injection wells as well as production wells, including hydrocarbon wells. Embodiments may be implemented using a tool that is suitable for testing, retrieval and sampling along sections of the formation. Embodiments may be implemented with tools that, for example, may be conveyed through a flow passage in tubular string or using a wireline, slickline, coiled tubing (wired and unwired), downhole, tractor, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline, MWD or LWD operations.

The present application is directed to improving performance of subterranean operations and more specifically, to improving performance and costs for directional drilling operations by using one or more modular stabilizers. Generally, collars are available in standard sizes and generally include a stabilizer forged as a single piece together with the collar. For example, an eight inch azimuthal lido density collar may have an 11.71 inch outer diameter stabilizer sleeve forged as a single piece together with the collar. A sensor may be positioned in the stabilizer sleeve. The sensor must maintain close proximity to the formation to obtain accurate information. Such an assembly may only be operational within a 12.25 inch wellbore or borehole. For a larger borehole formation, a larger new collar size with the corresponding outer diameter sleeve would need to be configured or created for the larger borehole.

Modular stabilizers according to one or more aspects of the present disclosure provide flexibility for different drilling operations, such as to conform or adapt to different borehole parameters. For example, a modular stabilizer may include a set of different components that are interchangeable or that may be otherwise selectively coupled or removed for a given overall stabilizer configuration using any one or more of the different components. For instance, a modular stabilizer may be configured using any one or more existing components or subset thereof to accommodate different borehole diameters, such as by varying the outer diameter of a given modular stabilizer configuration based on the borehole diameter. Modular stabilizers may reduce the expense of maintaining an inventory of different sized stabilizer and collar combinations at the drilling or operation site by allowing stabilizers to be formed or coupled to a collar in real-time according to the wellbore environment without requiring replacement of an entire section of the drill string or bottom hole assembly (BHA). Modular stabilizers may reduce the downtime and cost of a drilling operation as fitting a modular stabilizer requires less time to install, less manpower, fewer components maintained in inventory than installation of conventional stabilizers. Also, as modular stabilizers may be designed and configured to be removable and as distinct components, any given modular stabilizer component may be replaced without requiring removal of an entire section of the drill string or bottom hole assembly.

The disclosed tool, systems and methods are best understood in the context of the larger systems in which they operate. Accordingly, FIG. 1 shows an illustrative multi-component drilling environment. A drilling platform 102 is equipped with a derrick 104 that supports a hoist 106 for raising and lowering a drill string 108. The hoist 106 suspends a top drive 110 that rotates the drill string 108 as the drill string is lowered through the well head 112. Sections of the drill string 108 are connected by threaded connectors 107. Connected to the lower end of the drill string 108 is a drill bit 114. As drill bit 114 rotates, it creates a wellbore or borehole 120 that passes through various formations 121. A pump 116 circulates drilling fluid through a supply pipe 118 to top drive 110, through the interior of drill string 108, through orifices in drill bit 114, back to the surface via the annulus around drill string 108, and into a retention pit 124. The drilling fluid transports cuttings from the borehole into the pit 124 and aids in maintaining the integrity of the borehole 120.

In wells employing acoustic telemetry for logging while drilling (LWD), downhole sensors (including modular stabilizer tool 126) are coupled to a telemetry module 128 having an acoustic telemetry transmitter that transmits telemetry signals in the form of acoustic vibrations in the tubing wall of drill string 108. An acoustic telemetry receiver array 130 may be coupled to tubing below the top drive 110 to receive transmitted telemetry signals. One or more repeater modules 132 may be optionally provided along the drill string 108 to receive and retransmit the telemetry signals. Of course other telemetry techniques may be employed including mud pulse telemetry, electromagnetic telemetry, and wired drill pipe telemetry. Many telemetry techniques also offer the ability to transfer commands from the surface to the tool, thereby enabling adjustment of the tool's configuration and operating parameters. In some embodiments, the telemetry module 128 also or alternatively stores measurements for later retrieval when the tool returns to the surface.

A modular stabilizer tool 126 may be coupled to the drill string 108. While only one modular stabilizer tool 126 is shown, the present disclosure contemplates any number of modular stabilizer tools 126 positioned on or about the drill string 108 at any interval or distance apart. The modular stabilizer tool 126 may be communicatively coupled to any one or more of the telemetry module 128, repeater module 132, information handling system 134 or any other device (for example, an MWD/LWD tool, BHA or both) for receiving information from and sending information to the modular stabilizer tool 126. While information handling system 134 is illustrated positioned at the surface or about drilling platform 102, the present disclosure contemplates that information handling system 134 may be positioned at any location including, but not limited to, remote from the drilling platform 102, within borehole 120, or as part of any tool or component of drill string 108. The modular stabilizer tool 126 may be configured for a specific diameter or range of diameters of borehole 108 (as discussed below, for example, with respect to FIG. 3). The modular stabilizer tool 126 may be configured for use during drilling or may be employed in rotation motion mode.

Figure 2:
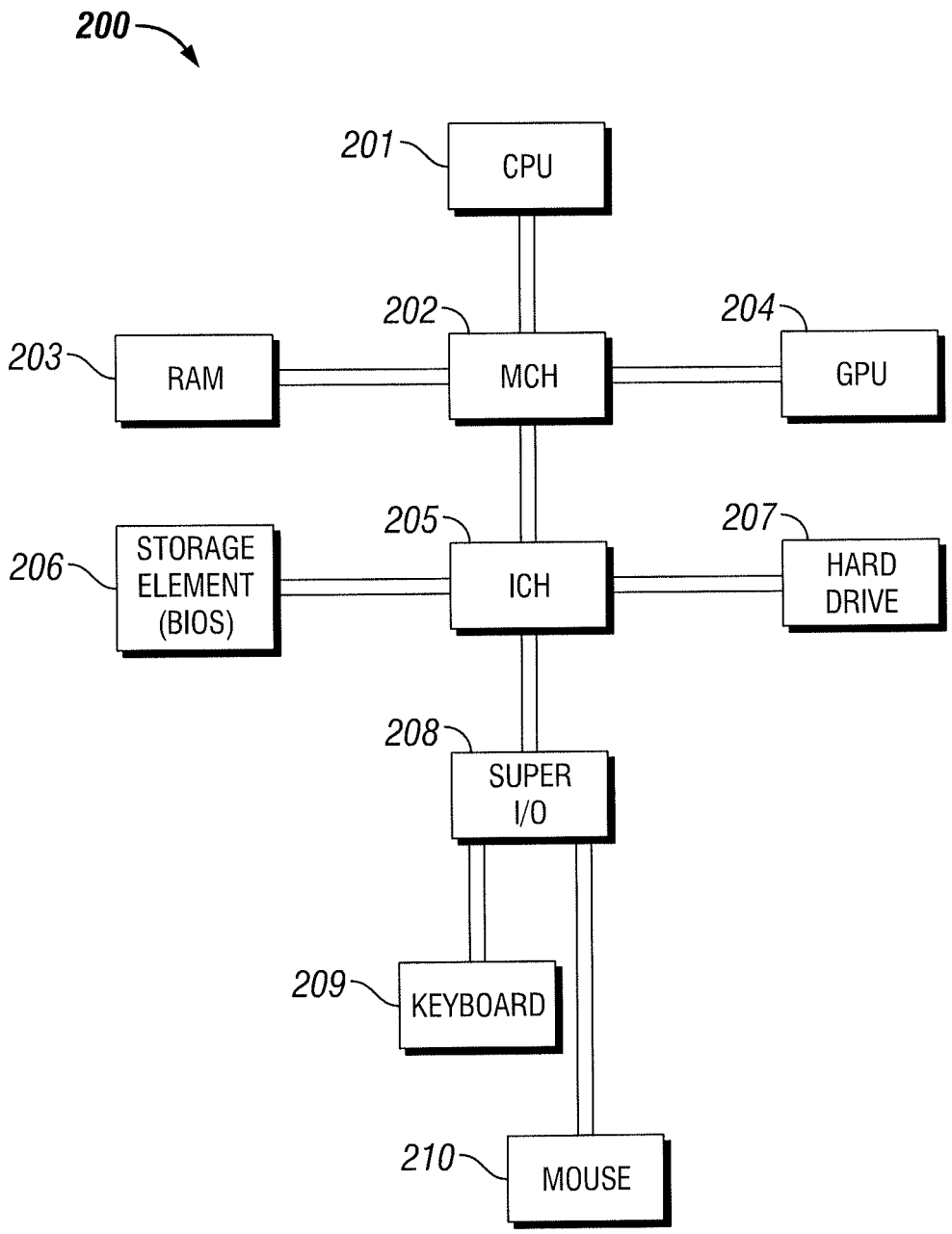
FIG. 2 is a diagram illustrating an example information handling system, according to aspects of the present disclosure.

FIG. 2 is a diagram illustrating an example information handling system 200 for use with or as part of one or more embodiments, according to aspects of the present disclosure. The system control unit 204 may take a form similar to the information handling system 200. A processor or central processing unit (CPU) 201 of the information handling system 200 is communicatively coupled to a memory controller hub or north bridge 202. The processor 201 may include, for example a microprocessor, microcontroller, digital signal processor (DSP), application specific integrated circuit (ASIC), or any other digital or analog circuitry configured to interpret and/or execute program instructions and/or process data. Processor 201 may be configured to interpret and/or execute program instructions or other data retrieved and stored in any memory such as memory 203 or hard drive 207. Program instructions or other data may constitute portions of a software or application for carrying out one or more methods described herein. Memory 203 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software or application may be retrieved and stored in memory 203 for execution by processor 201.

Modifications, additions, or omissions may be made to FIG. 2 without departing from the scope of the present disclosure. For example, FIG. 2 shows a particular configuration of components of information handling system 200. However, any suitable configurations of components may be used. For example, components of information handling system 200 may be implemented either as physical or logical components. Furthermore, in some embodiments, functionality associated with components of information handling system 200 may be implemented in special purpose circuits or components. In other embodiments, functionality associated with components of information handling system 200 may be implemented in configurable general purpose circuit or components. For example, components of information handling system 200 may be implemented by configured computer program instructions.

Memory controller hub 202 may include a memory controller for directing information to or from various system memory components within the information handling system 200, such as memory 203, storage element 206, and hard drive 207. The memory controller hub 202 may be coupled to memory 203 and a graphics processing unit 204. Memory controller hub 202 may also be coupled to an I/O controller hub or south bridge 205. I/O hub 205 is coupled to storage elements of the information handling system 200, including a storage element 206, which may comprise a flash ROM that includes a basic input/output system (BIOS) of the computer system. I/O hub 205 is also coupled to the hard drive 207 of the information handling system 200. I/O hub 205 may also be coupled to a Super I/O chip 208, which is itself coupled to several of the I/O ports of the computer system, including keyboard 209 and mouse 210.

Figure 3:
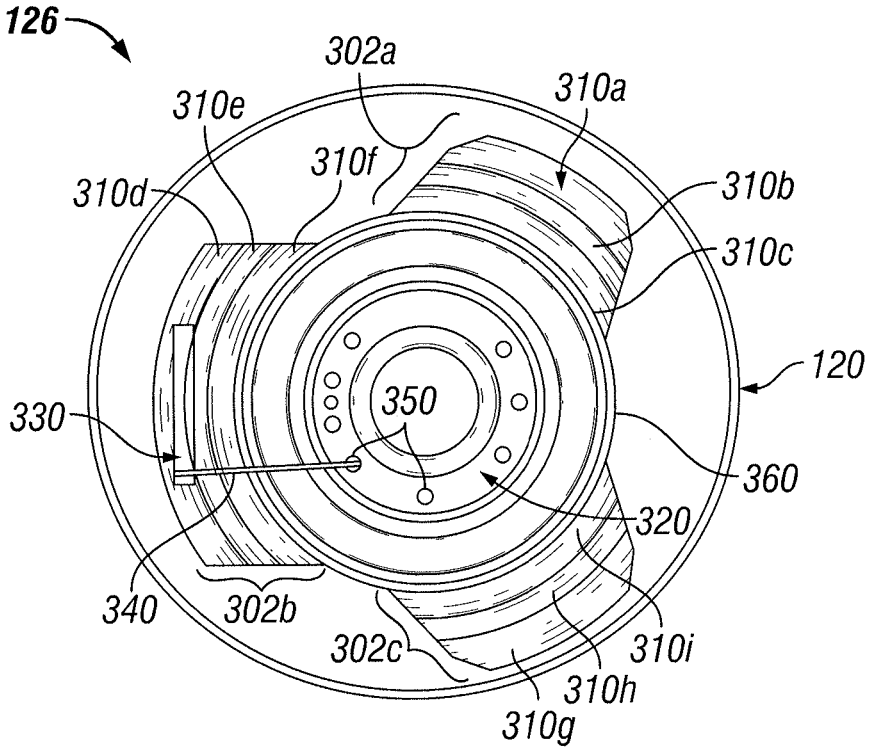
FIG. 3 shows a top view of an illustrative modular stabilizer tool according to one or more embodiments of the present disclosure.

FIG. 3 shows a top view of an illustrative modular stabilizer tool 126 according to one or more aspects of the present disclosure. A modular stabilizer tool 126 may be positioned on or about a drill string 108 (FIG. 1) within a borehole 120. Any number of modular stabilizer tools 126 may be positioned on or about the drill string 108 (FIG. 1) and may be positioned at any position or spacing linearly or axially along the drill string 108 (FIG. 1). A modular stabilizer tool 126 may comprise a collar 360 positioned on or about a drill string 108 (FIG. 1), an insert 320, and one or more modular stabilizer fins 301*a*, 302*b*, 302*c* (collectively, 302). The collar 360 may be any type of coupling according to a given operation. The collar 360 may be positioned on or about or comprise an insert 320. Insert 320 may comprise a sensory electronic device that includes one or more openings or apertures 350. The insert may be a cylindrical tubular structure for mounting a printed circuit board box for running of electrical wires and communication lines, pathways or wires. The one or more openings 350 may comprise a pathway that is enclosed or partially enclosed to allow one or more communications path 340 to communicatively couple to any one or more of the telemetry module 128 (FIG. 1), repeater module 132 (FIG. 1), information handling system 134, 200 (FIG. 1, FIG. 2) or any other device (for example, an MWD/LWD tool, BHA or both) for receiving information from and sending information to a sensor 330 of the modular stabilizer tool 126. The one or more openings 350 may be used as an electrical wireway, a hydraulic passage, or any other form of communication required between the insert 320, information handling system 134, 200 (FIG. 1, FIG. 2, respectively) or any other device or tool or combination thereof and any one or more sensors 330. One or more drilling operations may be altered based, at least in part, on information received from any one or more of the one or more sensors 330.

Any number of modular stabilizer fins 302 may be positioned on or circumferentially-spaced about the collar 360. For example, modular stabilizer fins 302*a*, 302*b* and 302*c* may be positioned on or circumferentially-spaced about the collar 360. While modular stabilizer fins 302*a*, 302*b* and 302*c* are illustrated as positioned approximately sixty degrees apart, the present disclosure contemplates any angular spacing between any number of modular stabilizer fins 302. A modular stabilizer tool 126 (FIG. 1) may include any number or quantity of modular stabilizer fins 302. The one or more modular stabilizer fins 302 for a given modular stabilizer tool 126 (FIG. 1) may be positioned at any linear location, any angular spacing or any axial location from any one or more other modular stabilizer fins 302 or any combination thereof along a drill string 108 (FIG. 1). The positioning of the one or more modular stabilizer fins 302 may be based, at least in part, on one or more characteristics of the formation, the type of sensors 330 positioned on or within the modular stabilizer fins 302, rotational speed of the drill string 108, any other downhole factor or characteristic or any combination thereof. In one or more embodiments, a modular stabilizer fin 302*a* may be positioned at the same axial location as modular stabilizer fins 302*b* and 302*c*. In one or more embodiments, modular stabilizer fin 302*a* may be offset axially from any one or more of modular stabilizer fin 302*b* and modular stabilizer fin 302*c*. In one or more embodiments, modular stabilizer fins 302*a*, 302*b*, 302*c* may have the same angular spacing from each other.

Modular stabilizer fins 302 may comprise any one or more modular stabilizer plates 310. For example, modular stabilizer fin 302*a* may comprise modular stabilizer plates 310*a*, 310*b* and 310*c*, modular stabilizer fin 302*b* may comprise modular stabilizer plates 310*d*, 310*e* and 310*f*, and modular stabilizer fin 302*c* may comprise modular stabilizer plates 310*g*, 310*h* and 310*i*. Any one or more modular stabilizer plates 310*a*, 310*b*, 310*c*, 310*d*, 310*e*, 310*f*, 310*g*, 310*h* and 310*i* may be collectively referred to as modular stabilizer plates 310. While each modular stabilizer fin 302 is illustrated with three modular stabilizer plates 310 respectively, the present disclosure contemplates any number of modular stabilizer plates 310 associated with any number of modular stabilizer fins 302. Also, while each modular stabilizer fin 302 comprises the same number of modular stabilizer plates 310 in FIG. 3, the present disclosure contemplates that each modular stabilizer fin 302 may comprise a different number of modular stabilizer plates 310 from any one or more other modular stabilizer fins 302. Any one or more of the modular stabilizer plates 310 may be configured with a predetermined width and length to accommodate any number of collars 360.

A sensor 330 may be positioned on, in or between any one or more modular stabilizer plates 310. As shown, sensor 330 is positioned between modular stabilizer plates 310*d* and 310*e*. Sensor 330 may be coupled to a communications pathway 340. In one or more embodiments, communications pathway 340 may comprise a communications wire, a hydraulic passageway or any one or more other communications pathways or ways to communicate information or any combination thereof. In one or more embodiments, sensor 330 may couple to a plurality of communications pathways 340. Sensor 330 may be any type of sensor including, but not limited to, acoustic, temperature, vibration, directional, pressure, fluid flow rate, porosity, electrical, nuclear/radioactive, magnetic, and any other type of sensor or combination thereof.

Figure 4:
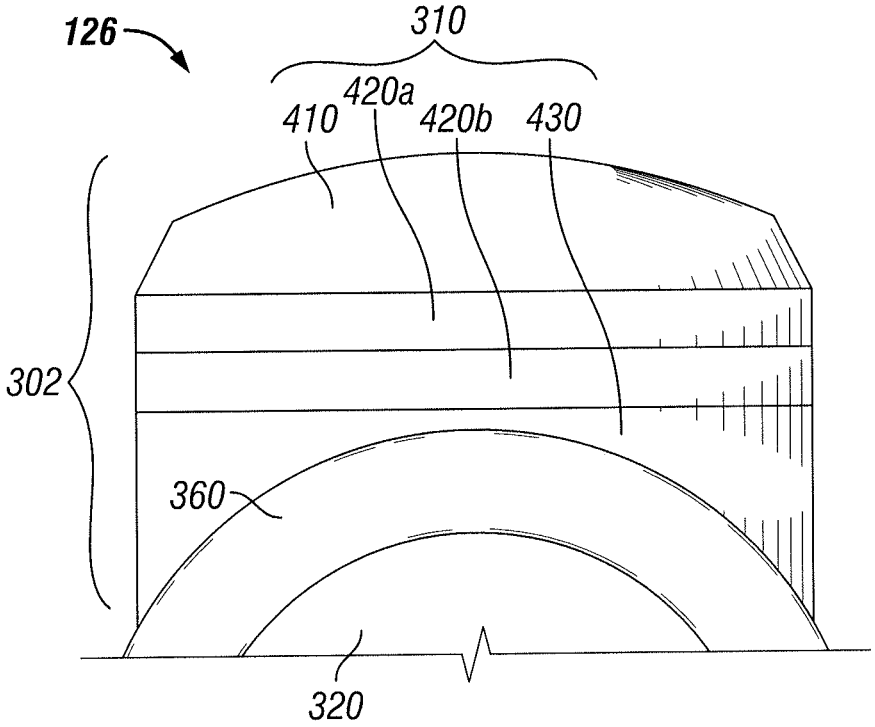
FIG. 4 shows an illustrative modular stabilizer tool in accordance with one or more embodiments of the present disclosure.

FIG. 4 shows an illustrative modular stabilizer tool 126 according to one or more embodiments of the present disclosure. A modular stabilizer tool 126 that comprises any one or more modular stabilizer fins 302 positioned on or about a collar 360 of a drill string 108 may comprise any one or more types of modular stabilizer plates 310. In one or more embodiments, modular stabilizer plates 310 may comprise a base spacer stabilizer plate 430, an intermediate spacer stabilizer plate 420, and an outer spacer stabilizer plate 410. A base spacer stabilizer plate 430 comprises a modular stabilizer plate 310 that conforms to the shape of the collar 360 so that the modular stabilizer fin 302 fits flush or is coupled flush to or is otherwise affixed to the collar 360. The base spacer stabilizer plate 430 may be coupled or affixed to the collar 360 via any one or more types of couplings or fasteners including, but not limited to, a bolt, screw, pin, magnet or any other fastener or may be coupled or affixed by a glue, adhesive, weld, sinter or any other adhering material. In one or more embodiments, a snap-fit or shrink-fit feature may be utilized to secure the base spacer stabilizer plate 430 to collar 360. While base spacer stabilizer plate 430 is illustrated with a flat portion at a top end and sides, the present disclosure contemplates that base stabilizer plate 430 may take any shape including, but not limited to, a rounded, beveled, curved, any other shape or combination thereof. In one or more embodiments, base spacer stabilizer plate 430 is configured to be used with a generic collar 360. For example, collar 360 may be selected based on the expected range of diameters for a given borehole 120 and the modular stabilizer fins 302 may be configured to extend or protrude as necessary by adding or coupling additional intermediate spacer stabilizer plates 420. In one or more embodiments, a modular stabilizer may comprise only a base spacer stabilizer plate 430.

In one or more embodiments, the modular stabilizer fins 302 may comprise any one or more intermediate spacer stabilizer plates 420. An intermediate spacer stabilizer plate 420 may be coupled or affixed to any other modular stabilizer plate 310 via any one or more types of couplings or fasteners including, but not limited to, a bolt, screw, pin, magnet or any other fastener or may be coupled or affixed by a glue, adhesive, weld, sinter or any other adhering material. In one or more embodiments, a snap-fit or shrink-fit feature may be utilized to secure the intermediate spacer stabilizer plates 430 to any one or more modular stabilizer plates 310. While two intermediate spacer stabilizer plates 420*a* and 420*b* (collectively 420) are shown, the present disclosure contemplates any number of intermediate spacer stabilizer plates 420. Intermediate spacer stabilizer plates 420 are positioned between a base spacer stabilizer plate 430 and an outer spacer stabilizer plate 410. Intermediate spacer stabilizer plates 420 may be any size or shape as appropriate for a given operation. In general, intermediate spacer stabilizer plates 420 are a similar or the same width and length as the base spacer stabilizer plate 430 so as to create a flush mounting with base spacer stabilizer plate 430. Any one or more intermediate spacer stabilizer plates 420 may have different widths or lengths. For example, intermediate spacer stabilizer plate 420*a* may have a first width different from a second width of intermediate spacer stabilizer plate 420*b*. In one or more embodiments, base spacer stabilizer plate 430 has a first width and outer spacer stabilizer plate 410 has a second width while intermediate spacer stabilizer plate 420*a* has a third width and intermediate spacer stabilizer plate 420*b* has a fourth width. At any given site, an inventory of intermediate spacer stabilizer plate 420 may comprise intermediate spacer stabilizer plate 420 of three, four, five or any number of different widths or lengths. The number of different widths or lengths inventoried at a site for intermediate spacer stabilizer plate 420 may depend on costs, storage space, expected range of diameters for borehole 120 or any other factors. In one or more embodiments, the number (if any) of intermediate spacer stabilizer plate 420 is selected based on any one or more of the inventory of different widths of intermediate space stabilizer plate 420, diameter of the collar 360, and diameter of the borehole 120.

In one or more embodiments, a modular stabilizer fin 302 may comprise an outer spacer stabilizer plate 410. Outer spacer stabilizer plate 410 is configured to mount, couple, or otherwise affix to one or more intermediate spacer stabilizer plates 420 or to base spacer stabilizer plate 430. The outer spacer stabilizer plate 410 may be coupled or affixed to any other intermediate spacer stabilizer plate 420 or base spacer stabilizer plate 430 via any one or more types of couplings or fasteners including, but not limited to, a bolt, screw, pin, magnet or any other fastener or may be coupled or affixed by a glue, adhesive, weld, sinter or any other adhering material. In one or more embodiments, the shape of the interface surface of the base spacer stabilizer plate 430 is the same as that of the intermediate spacer stabilizer plate 420 so that the outer spacer stabilizer plate 410 may so mount, couple, or otherwise affix to any other modular stabilizer plate 310. Outer spacer stabilizer plate 410 may comprise a beveled, rounded, curved, or any other shape out surface. The shape or dimensions of the outer spacer stabilizer plate 410 may be configured to avoid friction, control vibration, provide stability, allow for one or more sensors 330 to be closer in proximity to the borehole 120 or allow for improved performance of the downhole assembly or one or more downhole tools in general. In one or more embodiments, the outer spacer stabilizer plate 410 tapers at the outermost edges of the outer spacer stabilizer plate 410. In one or more embodiments, the outer spacer stabilizer plate 410 is smaller than or larger than the modular stabilizer plate 310 that the outer spacer stabilizer plate 410 is affixed or coupled to according to the specifics of a given operation. As noted, the base spacer stabilizer 430, intermediate spacer stabilizer plate 420 and outer spacer stabilizer plate 410 may couple, fasten or affix to each other via any one or more types of couplings including, but not limited to, a bolt, screw, pin, magnet or any other fastener or may be coupled or affixed by a glue, adhesive, weld, sinter or any other adhering material. In one or more embodiments, a snap-fit or shrink-fit feature may be utilized to secure the outer spacer stabilizers plate 410 to any other modular stabilizer plates 310.

Any one or more modular stabilizer plates 310 may be replaced. For example, if a modular stabilizer plate 310 (especially an outer spacer stabilizer plate 410 which is exposed to a harsher environment) experiences wear or damage, the damaged modular stabilizer plate 310 may be replaced with requiring replacement of an entire modular stabilizer tool or section of a drill string. For example, the outer spacer stabilizer plate 410 may be replaced without replacing any other modular stabilizer plate 310 or collar 360. While the present disclosure discusses removing any one or more modular stabilizer plates 310 to configure the modular stabilizer tool 126 to accommodate the diameter of any borehole 120, the present disclosure also contemplates that the modular stabilizer plates 310 may be permanently affixed to each other, to the collar 360 or both or any combination of permanent and temporary coupling.

Figure 5:
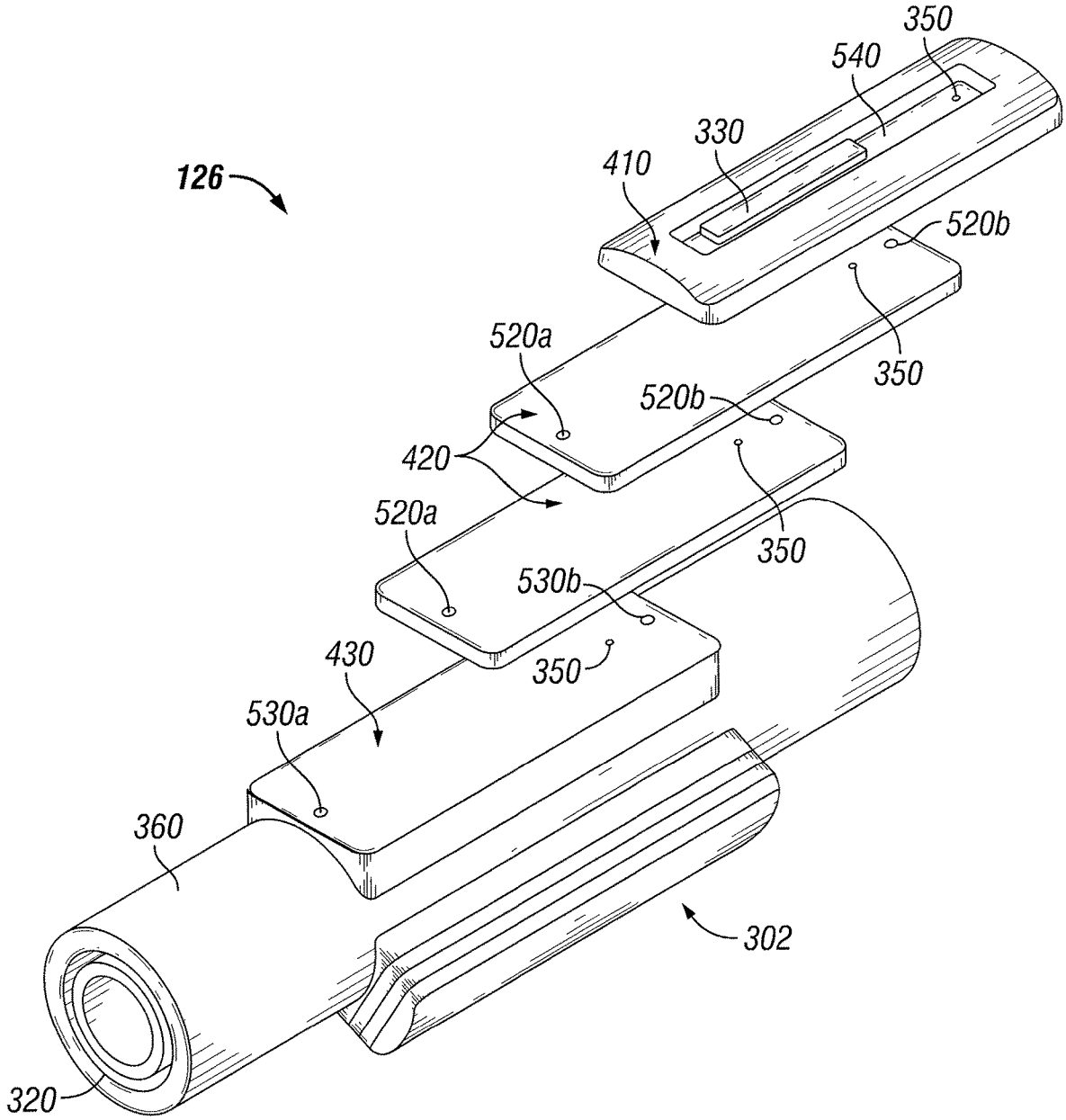
FIG. 5 shows an illustrative modular stabilizer tool in accordance with one or more embodiments of the present disclosure.

FIG. 5 shows an illustrative modular stabilizer tool 126 according to one or more embodiments of the present disclosure. Base spacer stabilizer plate 430 may comprise one or more guide pins 530, for example, guide pins 530*a* and 530*b*, to align base spacer stabilizer plate 430 with intermediate spacer stabilizer plate 420 (as illustrated) or without spacer stabilizer plate 410 (not shown). Intermediate spacer stabilizer plate 420 may comprise one or more guide pins 520, for example, guide pins 520*a* and 520*b*. Guide pins 530 and 520 may align with or mate to one or more receptacles, openings or apertures (not shown) of a corresponding modular stabilizer plate 310.

Opening 350 traverses from the outer spacer stabilizer plate 410 through any intervening modular stabilizer plate 310 (for example, one or more intermediate spacer stabilizer plates 420 and base spacer stabilizer plate 430) through the collar 360 and to the insert 320 to provide a communications pathway. For example, a communications path 340 may couple to sensor 330 positioned within inset or groove 540. Groove 540 may be of a sufficient depth and width such that sensor 330 does not protrude or extend beyond the outer surface of outer spacer stabilizer plate 410. In one or more embodiments, sensor 330 is positioned on an outer surface of the outer spacer stabilizer plate 410. Any one or more modular stabilizer fins 302 may comprise a groove 540, a sensor 330 or both. Sensor 330 may be any type of suitable sensor. In one or more embodiments, sensor 330 is positioned within or between any one or more modular stabilizer plates 310 (for example, base spacer stabilizer plate 430, intermediate spacer stabilizer plate 420 and outer spacer stabilizer plate 410). In one or more embodiments, a plurality of sensors 330 are positioned within, on or between any one or more modular stabilizer plates 310.

In one or more embodiments, the modular stabilizer tool 126 may comprise one or more modular stabilizer fins 302 affixed or positioned on or about a sleeve (not shown) that is slidably configured on, fitted on, coupled to or otherwise affixed to the collar 360 or drilling string 108. In one or more embodiments, any one or more modular stabilizer fins 302 may be of a different shape and size than any one or more other modular stabilizer fins 302. The length and width of any given modular stabilizer 302 may depend on one or more factors including, but not limited to, one or more electrical components positioned within or about the modular stabilizer fin 302 or the insert 320, the sensor 330, the type of formation 112, the type of operation, depth of drilling, or any other factor or criteria or combination thereof. In one or more embodiments, a modular stabilizer fin 302 may be surface hardened to mitigate wear. In one or more embodiments, any type of secondary process may be performed on any one or more layers of the modular stabilizer fin 302 to mitigate wear. In one or more embodiments, a modular stabilizer fin 302 may be eccentric or offset such that a first side of the modular stabilizer fin 302 may comprise more intermediate portions than a second side of the modular stabilizer fin 302.

The present disclosure provides systems and methods for improving drilling operations. In one or more embodiments, a cost reduction of operations may be achieved by a reduction in inventory at a site of a drill collars with multiple sized stabilizers as the present disclosure contemplates using a drill collar that is configured to receive or have positioned about it one or more removable modular stabilizer plates. Down time of a drilling operation may be reduced as the removal, addition or both of a modular stabilizer plate requires less time and manpower than the traditional approach of removing a section of a drill string to replace the collar. A reduction in costs may also be achieved by only replacing the damaged or worn modular stabilizer plate instead of replacing an entire drill collar. The present disclosure provides for greater versatility as any collar may be custom configured with one or more combinations of modular stabilizer plates to meet the requirements of a given diameter of a borehole 120. Further, greater flexibility is provided as any one or more modular stabilizer plates may be of a different length, width or both from any other modular stabilizer plate to allow for different length collars and electronics.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. Consequently, the disclosure is intended to be limited only by the spirit and scope of the appended claims, giving full cognizance to equivalents in all respects. The terms in the claims have their plain, ordinary meaning unless otherwise explicitly and clearly defined by the patentee.

In one or more embodiments a drilling method comprises configuring a modular stabilizer tool, wherein configuring the modular stabilizer tool comprises removably positioning one or more modular stabilizer plates to form a modular stabilizer fin and positioning the modular stabilizer fin on a collar, positioning the modular stabilizer tool about a drill string and performing one or more drilling operations using the drill string. In one or more embodiments, configuring the modular stabilizer tool further comprises positioning the collar about an insert and communicatively coupling a sensor to the insert. The one or more modular stabilizer plates may comprise a base spacer stabilizer plate coupled to the collar and an outer spacer stabilizer plate coupled to the base spacer stabilizer plate, wherein the base spacer stabilizer plate and the outer spacer stabilizer plate are removable. In one or more embodiments, configuring the modular stabilizer tool further comprises removably positioning one or more intermediate spacer stabilizer plates between the base spacer stabilizer plate and the outer spacer stabilizer plate. In one or more embodiments, the one or more modular stabilizer plates comprise a base spacer stabilizer plate, one or more intermediate spacer stabilizer plates and an outer spacer stabilizer plate, and wherein configuring the modular stabilizer tool further comprises removably positioning the base spacer stabilizer plate on the collar, removably positioning the one or more intermediate spacer stabilizer plates on the base spacer stabilizer plate, and removably positioning the outer spacer stabilizer plate on the one or more intermediate base spacer stabilizer plates. In one or more embodiments, the drilling method further comprises altering at least one of the one or more modular stabilizer plates, wherein altering the at least one of the one or more modular stabilizer plates comprises at least one of removing at least one of the one or more modular stabilizer plates and removably positioning at least one additional modular stabilizer plate about the collar.

In one or more embodiments, a drilling system comprises a drill string and a modular stabilizer tool positioned on the drill string, wherein the modular stabilizer tool comprises one or more modular stabilizer fins, wherein the one or more modular stabilizer fins comprise one or more modular stabilizer plates removably positioned on a collar. In one or more embodiments, the drilling system further comprises an insert positioned on the drill string, wherein the collar is positioned about the insert and a sensor communicatively coupled to the insert. In one or more embodiments, the one or more modular stabilizer plates comprise a base spacer stabilizer plate removably positioned on the collar and an outer spacer stabilizer plate removably positioned on the base spacer stabilizer plate. In one or more embodiments, the one or more modular stabilizer plates further comprise one or more intermediate spacer stabilizer plates removably positioned between the base spacer stabilizer plate and the outer spacer stabilizer plate. In one or more embodiments, the drilling system further comprises a communications wire positioned through an opening of each of the one or more modular stabilizer plates to communicatively couple the sensor to the insert. In one or more embodiments, the one or more modular stabilizer plates comprise a base spacer stabilizer plate removably positioned on the collar, one or more intermediate spacer stabilizers plates removably positioned on the base spacer stabilizer plate and an outer spacer stabilizer plate removably positioned on the one or more intermediate spacer stabilizer plates. In one or more embodiments, the drilling system further comprises a sleeve positioned on the collar, wherein the one or more modular stabilizer plates are removably positioned about the sleeve.

In one or more embodiments a modular stabilizer tool comprises a collar and one or more circumferentially-spaced modular stabilizer fins positioned about the collar, wherein the one or more modular stabilizer fins comprise one or more removable modular stabilizer plates. In one or more embodiments, the modular stabilizer tool further comprises an insert, wherein the collar is positioned about the insert and a sensor communicatively coupled to the insert. In one or more embodiments, the modular stabilizer tool further comprises a communications wire positioned through an opening of each of the one or more modular stabilizer plates to communicatively couple the sensor to the insert. In one or more embodiments, the one or more modular stabilizer plates comprise a base spacer stabilizer plate removably positioned on the collar and an outer spacer stabilizer plate removably positioned on the base spacer stabilizer plate. In one or more embodiments, the one or more modular stabilizer plates further comprise one or more intermediate spacer stabilizer plates removably positioned between the base spacer stabilizer plate and the outer spacer stabilizer plate. In one or more embodiments, the one or more modular stabilizer plates comprise a base spacer stabilizer plate removably positioned on the collar, one or more intermediate spacer stabilizer plates positioned on the base spacer stabilizer plate and an outer spacer stabilizer plate removably positioned on the one or more intermediate spacer stabilizer plates. In one or more embodiments, the modular stabilizer tool a sleeve positioned on the collar, wherein the one or more modular stabilizer plates are removably positioned about the sleeve.

What is claimed is:

1. A drilling method comprising:

configuring a modular stabilizer tool, wherein configuring the modular stabilizer tool comprises removably positioning one or more modular stabilizer plates to form a-one or more modular stabilizer fins and positioning the one or more modular stabilizer fins on a collar, wherein there is a communications wire positioned through an opening of each of the one or more modular stabilizer plates of at least one of the one or more modular stabilizer fins;

positioning the modular stabilizer tool on a drill string; and performing one or more drilling operations using the drill string.

2. The drilling method of claim 1, wherein configuring the modular stabilizer tool further comprises:

positioning the collar about an insert; and communicatively coupling a sensor to the insert.

3. The drilling method of claim 1, wherein the one or more modular stabilizer plates comprise a base spacer stabilizer plate coupled to the collar and an outer spacer stabilizer plate coupled to the base spacer stabilizer plate, wherein the base spacer stabilizer plate and the outer spacer stabilizer plate are removable.

4. The drilling method of claim 3, wherein configuring the modular stabilizer tool further comprises:

removably positioning one or more intermediate spacer stabilizer plates between the base spacer stabilizer plate and the outer spacer stabilizer plate.

5. The drilling method of claim 1, wherein the one or more modular stabilizer plates comprise a base spacer stabilizer plate, one or more intermediate spacer stabilizer plates and an outer spacer stabilizer plate, and wherein configuring the modular stabilizer tool further comprises:

removably positioning the base spacer stabilizer plate on the collar;

removably positioning the one or more intermediate spacer stabilizer plates on the base spacer stabilizer plate; and removably positioning the outer spacer stabilizer plate on the one or more intermediate base spacer stabilizer plates.

6. The drilling method of claim 1, further comprising:

altering at least one of the one or more modular stabilizer plates, wherein altering the at least one of the one or more modular stabilizer plates comprises at least one of:

removing at least one of the one or more modular stabilizer plates; and removably positioning at least one additional modular stabilizer plate about the collar.

7. A drilling system, comprising:

a drill string;

a modular stabilizer tool positioned on the drill string, wherein the modular stabilizer tool comprises one or more modular stabilizer fins, wherein the one or more modular stabilizer fins comprise one or more modular stabilizer plates removably positioned on a collar; and a communications wire positioned through an opening of each of the one or more modular stabilizer plates of at least one of the one or more modular stabilizer fins.

8. The drilling system of claim 7, further comprising:

an insert positioned on the drill string, wherein the collar is positioned about the insert; and a sensor communicatively coupled to the insert.

9. The drilling system of claim 8, wherein the communications wire communicatively couples the sensor to the insert.

10. The drilling system of claim 7, wherein the one or more modular stabilizer plates comprise a base spacer stabilizer plate removably positioned on the collar and an outer spacer stabilizer plate removably positioned on the base spacer stabilizer plate.

11. The drilling system of claim 10, wherein the one or more modular stabilizer plates further comprise one or more intermediate spacer stabilizer plates removably positioned between the base spacer stabilizer plate and the outer spacer stabilizer plate.

12. The drilling system of claim 7, wherein the one or more modular stabilizer plates comprise a base spacer stabilizer plate removably positioned on the collar, one or more intermediate spacer stabilizer plates removably positioned on the base spacer stabilizer plate and an outer spacer stabilizer plate removably positioned on the one or more intermediate spacer stabilizer plates.

13. The drilling system of claim 7, further comprising:

a sleeve positioned on the collar, wherein the one or more modular stabilizer plates are removably positioned about the sleeve.

14. A modular stabilizer tool, comprising:

a collar;

one or more circumferentially-spaced modular stabilizer fins positioned about the collar, wherein the one or more modular stabilizer fins comprise one or more removable modular stabilizer plates; and a communications wire positioned through an opening of each of the one or more modular stabilizer plates of at least one of the one or more modular stabilizer fins.

15. The modular stabilizer tool of claim 14, further comprising:

an insert, wherein the collar is positioned about the insert; and a sensor communicatively coupled to the insert.

16. The modular stabilizer tool of claim 15, wherein the communications wire communicatively couples the sensor to the insert.

17. The modular stabilizer tool of claim 14, wherein the one or more modular stabilizer plates comprise a base spacer stabilizer plate removably positioned on the collar and an outer spacer stabilizer plate removably positioned on the base spacer stabilizer plate.

18. The modular stabilizer tool of claim 17, wherein the one or more modular stabilizer plates further comprise one or more intermediate spacer stabilizer plates removably positioned between the base spacer stabilizer plate and the outer spacer stabilizer plate.

19. The modular stabilizer tool of claim 14, wherein the one or more modular stabilizer plates comprise a base spacer stabilizer plate removably positioned on the collar, one or more intermediate spacer stabilizer plates positioned on the base spacer stabilizer plate and an outer spacer stabilizer plate removably positioned on the one or more intermediate spacer stabilizer plates.

20. The modular stabilizer tool of claim 14, further comprising:

a sleeve positioned on the collar, wherein the one or more modular stabilizer plates are removably positioned about the sleeve.

* * * * *